United States Patent [19]

Blome et al.

[11] Patent Number: 4,852,281

[45] Date of Patent: Aug. 1, 1989

[54] FRAME

[75] Inventors: Fred C. Blome, Maumee; Jack L. Bernard, Toledo, both of Ohio

[73] Assignee: Bernard Engraving Co., Toledo, Ohio

[21] Appl. No.: 158,840

[22] Filed: Feb. 22, 1988

[51] Int. Cl.[4] ..... A47G 1/06; G09F 1/12

[52] U.S. Cl. ..... 40/152.1

[58] Field of Search ..... 40/152, 152.1, 124; 248/460

[56] References Cited

U.S. PATENT DOCUMENTS

| | | | |
|---|---|---|---|
| 2,450,495 | 10/1948 | Ullmann | 40/152.1 |
| 2,758,402 | 8/1956 | Fulmer | 40/152.1 |
| 2,769,261 | 11/1956 | Laughlin | 40/152.1 |
| 2,958,490 | 11/1960 | Johnson | 248/460 |
| 4,291,882 | 9/1981 | Del Monte | 40/124 |
| 4,441,268 | 4/1984 | Scott | 40/152.1 |
| 4,553,344 | 11/1985 | Rubin et al. | 40/152 |
| 4,655,428 | 4/1987 | McCrea | 40/152.1 |
| 4,656,764 | 4/1987 | Fengler | 40/152.1 |

*Primary Examiner*—John J. Wilson
*Assistant Examiner*—Michael Lynch
*Attorney, Agent, or Firm*—Emch, Schaffer, Schaub & Porcello Co.

[57] ABSTRACT

A frame for receiving objects to be displayed is disclosed. The frame has a display side for an object and a back plate positioned opposite said display side. At least one opening is positioned in the back plate of the frame. At least one securing device is positioned adjacent the opening and the securing device extends at least partially over the opening. A support member having a projection on one side comprises part of the frame. The projection is disposed for insertion into the opening in the back plate. The securing device engages the support member to maintain the projection of the support member in the opening. The support member extends from the back plate whereby the support member supports the frame in a manner where an object positioned on the display side of the frame can be viewed.

10 Claims, 1 Drawing Sheet

FRAME

BACKGROUND OF THE INVENTION

This invention is directed to a frame for displaying objects. More particularly, the invention is directed to a way of supporting the frame in different orientations so that the object in the frame can be viewed from the desired orientation. Principally the invention is directed to frames in which pictures will be displayed and more particularly to low cost plastic frames.

The particular frame of this invention is designed to rest on a support surface as opposed to a frame that is hung on a wall. In the past, frames that have been designed to rest on a support surface such as a desk or a table had a support to maintain the frame in a desired orientation. Usually this support is a portion of the back of the frame that is hingedly connected to the frame. The hinge member can be pivoted away from the back of the frame to support for the frame in the desired orientation. In recent years plastic has been used as a frame material and in particular transparent plastic. The plastic material can be easily shaped to provide a low cost frame that can be used for displaying pictures. However, it is very difficult to incorporate a hinged support section in the back of a plastic material to provide a support that will maintain the frame at the proper orientation when the frame is positioned on a desk or a table. It is very difficult to incorporate a hinged member into a frame that is made of a hard plastic material. On some platic frames a portion of the back plate of the frame pivot out from the frame to provide the support member. In these applications the plastic material acts as the hinge mechanism for the support member. However, it is difficult to build such a plastic hinge into the material and such hinges can be broken if used improperly.

Other plastic frame manufacturers have developed a support pedestal upon which the frame could be rested to provide support when the frame was used on a desk top or a table. The support pedestal is usually a plastic L-shaped member that is bulky and makes it difficult to package the frame in a compact package that can be easily shipped and displayed in a store.

Accordingly, there is a need in the industry to provide a low cost plastic picture frame having a support member that will allow the frame to be utilized on a desk or a table where its support member can be easily packaged with the frame.

Accordingly, it is an object of the invention to provide an improved picture frame.

It is an object of the invention to provide a picture frame with a removable support member that can be positioned flat against the back of the picture frame to facilitate packaging of the frame.

These and other objects of the invention form a review of the following detailed description of the invention.

SUMMARY OF THE INVENTION

A frame for receiving objects to be displayed is disclosed. The frame has a display side for an object and back plate positioned opposite said display side. At least one opening is positioned in the back plate of the frame. At least one securing device is positioned adjacent the opening and the securing device extends at least partially over the opening. A support member having a projection on one side comprises part of the frame. The projection is disposed for insertion into the opening in the back plate. The securing device engages the support member to maintain the projection of the support member in the opening. The support member extends from the back plate whereby the support member supports the frame in a manner where an object positioned on the display side of the frame can be viewed.

DESCRIPTION OF THE PREFERRED EMBODIMENTS

Figure 1:
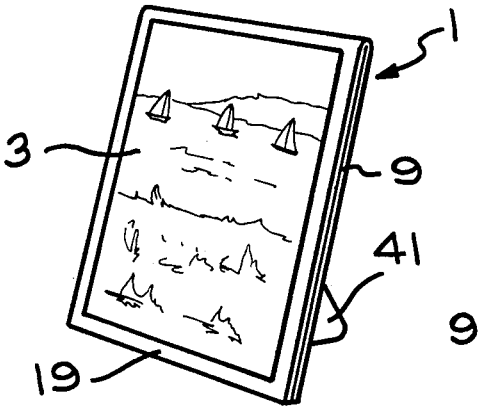
FIG. 1 is a perspective view showing the front of the frame of the present invention.
Figure 2:
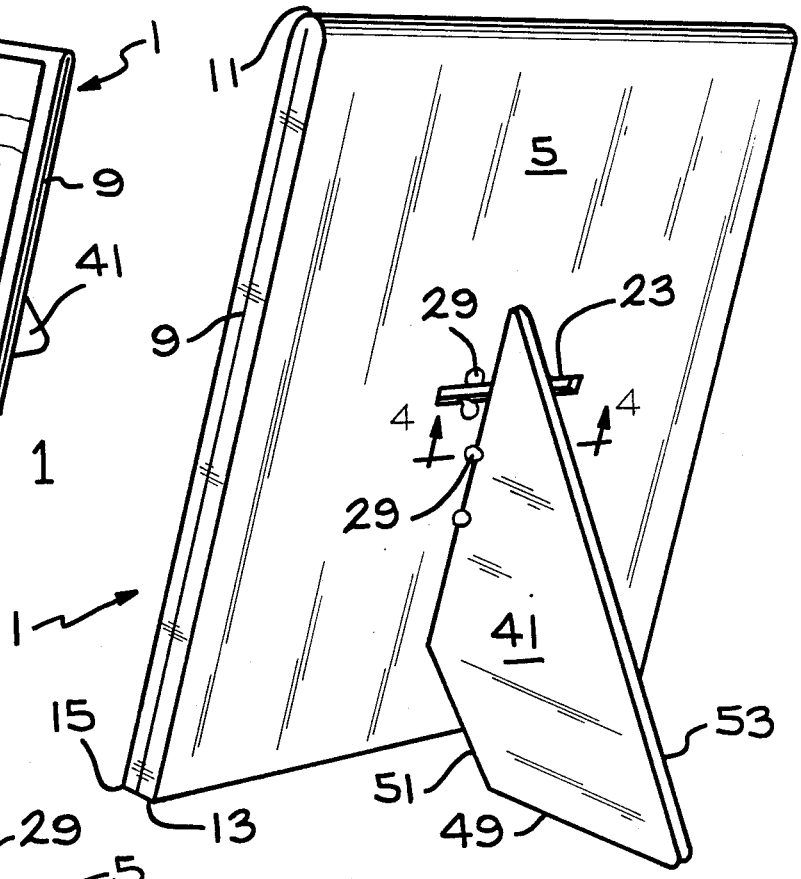
FIG. 2 is a perspective view showing the insertion of the support member for the frame.
Figure 4:
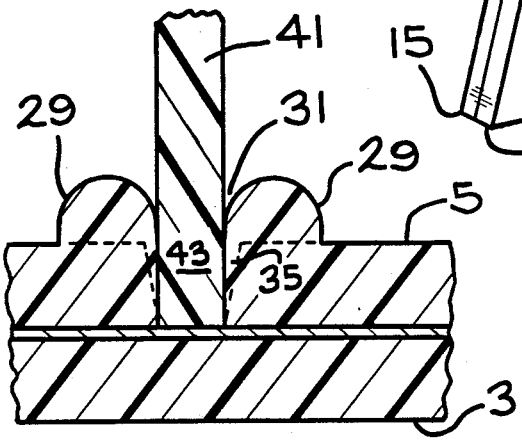
FIG. 4 is a cross-sectional view taken along the line 4—4 of FIG. 2.
Figure 3:
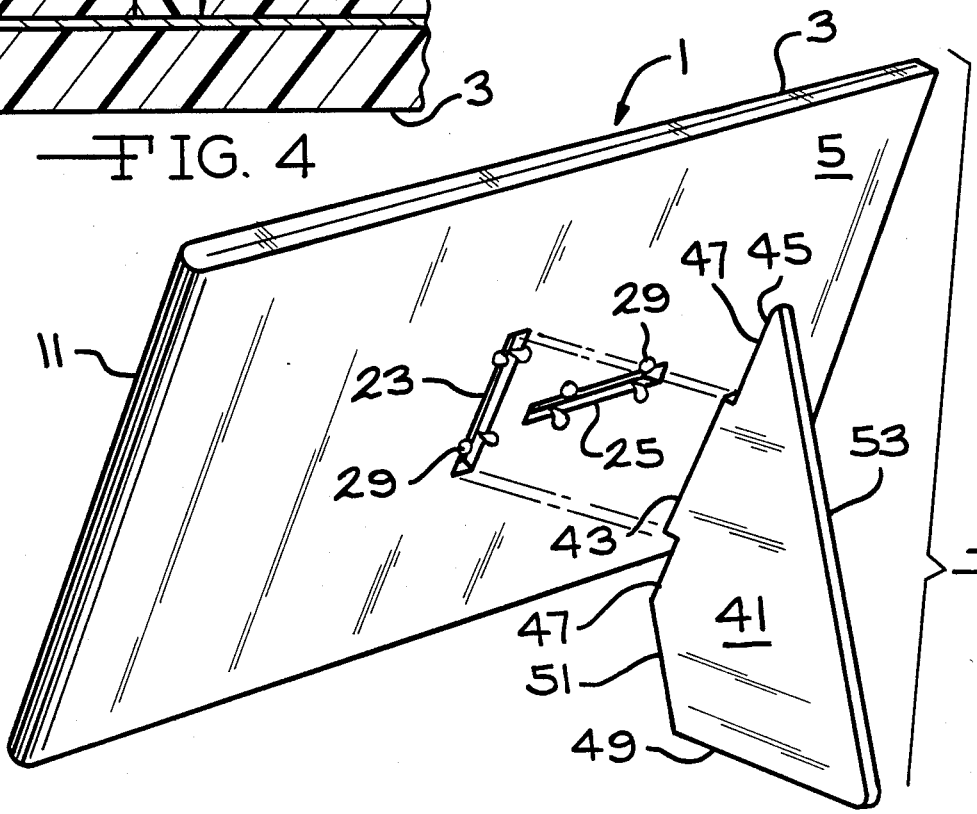
FIG. 3 is an exploded perspective view showing the insertion of the support member for the frame.

The invention is directed to a frame for receiving objects to be displayed. The frame has a display side for the object and a back plate positioned opposite the display side. More particularly, the invention is directed to a frame having a particular support that can be removably attached to the frame for maintaining the frame at a desired orientation to facilitate the viewing of the object held in the frame. Although the present invention can be utilized with almost any type of a frame, the invention will be described with reference to a picture frame to facilitate the understanding of the invention. However, it should be understood that this description should not in any way be construed to be limiting on the applications for the frame of the present invention. The invention will be more readily understood by referring to the attached drawings in connection with the following description.

The invention is directed to a frame 1 having a display side 3 and a back plate 5. An opening 9 is positioned along at least one side of the frame 1 so that an object to be displayed can be positioned in the interior of the frame and seen through the display side 3 of the frame. For the frame shown in the drawings, the frame is formed of a transparent plastic material that is a single sheet of material. The transparent plastic material is folded at edge 11 so that the plastic material can form the back plate 5 and display side 3 of the frame. The edge 11 forms a radius on this end of the frame and the sides of the frame are folded so that the end 13 of the back plate 5 and the end 15 of the display sides 3 that are spaced apart from the edge 11 adjacent one another and are usually urged toward one another. In this particular embodiment for the frame 1 an opening 9 is positioned on each side of the frame member and the opening 9 extends along the end of the frame member that is spaced apart from the edge 11. The material to be viewed is positioned on the frame between the display side 3 and the back plate 5. Since the display side 3 is made of a transparent material, the object can be viewed directly through the transparent material. If the frame were constructed of a nontransparent material, a transparent window or a cut out could be provided on the display side 3 to allow the object to be viewed once it has been positioned between the display side 3 and the back plate 5. An opacque border 19 can be positioned around the perimeter of the display side 3 to provide a definite border around the object to be displayed and to improve the aesthetic appearance of the frame.

Positioned on the back plate 5 of the frame 1 is a first slot 23 and a second slot 25. The first and second slots usually pass entirely through the back plate 5 and are in communication with the interior of the frame. However, it should be noted that it is not necessary for the slots to pass entirely through the back plate 5 and that the slots could extend for almost any depth into the back plate. The sides of the first slot 23 and second slot 25 converge as they advance towards the interior of the frame 1. The first slot 23 is positioned so that its longitudinal axis is substantially parallel to the edge 11 of the frame 1. The second slot 25 is disposed so that its longitudinal axis is substantially perpendicular to the edge 11.

Position in opposed relationship along the sides of the first slot 23 and the second slot 25 are projections 29. The opposed projections are substantially spherical in shape and define a passageway 31 between the opposed projections. The passageway 31 is in communication with the slots in the back plate of the frame 1. The projections are disposed on the back plate 5 so that the passageway defined by the opposed projections is slightly narrower than the opening defined by the first and second slots. The main portion of the projections 29 are positioned on the surface of the back plate 5. However, a cylindrical portion 35 of the projections 29 extends into the first and second slots and terminate at the bottom of the slots. The cylindrical portions 35 of the projections 29 extend the passageway 31 defined by the projections into the slots. The portion of the passageway 31 defined by the cylindrical portions 35 is also narrower than the width of the first slot 23 or the second slot 25. In practice it has been found that it is desirable to have a pair of opposed projections located on each end of the slots in the back plate 5. However, it should be understood that any number of opposed projections can be utilized and that the sizes of the frame and the slot will dictate on the number of projections required. However, in practice it has been found that it is desirable to have at least two opposed projections positioned along each slot.

A support member 41 is used to maintain the frame 1 at the desired orientation so that the object positioned in the frame can be properly viewed. The support member 41 has a projection 43 and extends from side 45 of the support member 41. The projection 43 has a length that is slightly smaller than the length of the first or second slots and a width that is slightly smaler than the width of the first and second slots. The projection is disposed for insertion into either the first slot 23 or the second slot 25. The thickness of the projection 43 is, however, larger than the opening defined by the passageway 31 between the opposed projections 29 positioned on the back plate 5 adjacent to the first and second slots. The projection 43 on the support member 41 extends from the side 45 for a distance that will allow the projection 43 to extend almost entirely into the first or second slot. The side 45 of the support member 41 has shoulders 47 that extend on either side of the projection 43. The shoulders 47 are disposed for engaging the back plate 5 when the projection 43 is inserted into the first 23 or the second slot 25. Positioned in spaced apart relationship with the side 45 is engagement side 49 of the support member 41. Engagement side 49 is disposed to engage the surface upon which the frame 1 is positioned to maintain the frame at a desired orientation. Side 45 and engagement side 49 are connected by short side 51 and long side 53 of the support member 41. Short side 51 and long side 53 are disposed in opposed substantially parallel relationship.

In operation, the support member 41 is supplied separately with the frame 1. An object to be displayed is inserted into the interior of the frame 1 through opening 9 positioned around the perimeter of the frame. The object to be displayed is positioned so that the object can be seen through the display side 3 of the frame. The object to be displayed is disposed so that the object can be seen in the most advantageous orientation when either the first slot 23 or the second slot 25 is positioned substantially perpendicular to the surface upon which the frame is supported. When the proper orientation for the frame is determined, the projection 43 on the support member 41 is inserted into either the first slot 23 or the second slot 25. As the projection 43 is advanced into the appropriate slot it must pass through the passageway 31 defined by the opposed projections 29. The passageway 31 is narrower than the thickness of the projection 43 and the projection 43 must be forced through this passageway and into the slot. When the projection 43 is advanced all the way into the appropriate first or second slot the side 45 of the support member 41 will be adjacent the back plate 5 of the frame. The sides of the first and second slots converge as they advance towards the interior of the frame the sides of the slot will also engage the end of the projection 43 that is spaced apart from the side 45 of the support member 41. As the projection 43 is inserted into the appropriate slot the cylindrical poritions 35 of the projections 29 will also engage the projection 43. Thus, the projections 29 and the cylindrical portions 35 will engage the projection 43 and the sides of the support member 41 to securely hold the support member 41 in either the first slot 23 or the second slot 25 and keep the support member 41 in engagement with the back plate 5 of the frame 1. Once the support member 41 is properly secured to the frame 1 the engagement side 49 of the support member 41 is properly disposed to engage the surface upon which the frame is supported. This acts to maintain the frame at the desired angular relationship with the support surface so that the object can be most advantageously viewed. It should be noted that the engagement side 49 of the support member 41 is disposed to rest substantially flat on the surface upon which the frame is supported when the support member 41 is properly secured to the back plate 5 of the frame 1.

If it is desired to change the orientation of the frame to obtain a different viewing perspective for an object, the support member 41 can be removed from the frame 1 by removing the projection 43 from the slot in which it is positioned. The frame can then be rotated to that the projection 43 on the support member 41 is in alignment with the slot that provides the appropriate orientation for the frame. The projection 43 can be inserted into the slot as previously discussed so that the support member 41 can maintain the frame at the desired position or angle for viewing the object placed in the frame.

From the above it is clear that the support member 41 can be easily positioned in and removed from the frame 1 to provide a support that maintains the frame at the proper orientation or angle for viewing an object displayed in the frame. Since the support member 41 can be removed from the frame, it is very easy to place the support member 41 so that it is flat along the back plate 5 of the frame so that the frame can be easily packaged, stored and displayed. The removable support member also provides an inexpensive and easy way to properly support the frame in the desired viewing position. It is also possible that the support member 41 can be positioned on the interior of the frame for purposes of packaging so that the support member takes up as little space as possible.

The above description is given for the sake of explanation. Various modifications and substitutions can be made without departing from the scope of the invention as defined by the following claims.

What I claim is:

1. A frame for receiving objects to be displayed having a display side for an object and a back plate positioned opposite said display side, said frame comprising:

at least one opening positioned in said back plate of said frame;

at least one pair of opposed securing devices positioned adjacent said opening, said securing devices extending at least partially over said opening, said opposed securing devices forming a passageway;

a support member having a projection on one side, said projection being disposed for insertion into said opening in said back plate, said passageway formed by said opposed securing devices being slightly narrower than said thickness of said projection, said securing devices engaging said support member to maintain said projection of said support member in said opening, said support member extending from said back plate whereby said support member supports said frame in a manner where an object positioned on said display side can be viewed.

2. The frame of claim 1 wherein a plurality of securing devices are positioned adjacent said opening.

3. The frame of claim 2 wherein said securing devices are positioned in substantially opposed relationship on opposite sides of said opening.

4. The frame of claim 3 wherein said securing device has two opposed projections at one end of said opening and two opposed projections at said other end of said opening that form said passageway.

5. The frame of claim 3 wherein said portion of said projections of said securing devices that form said passageway are substantially spherical in shape.

6. The frame of claim 1 wherein said side of said support member extends beyond said projection and beyond said ends of said opening, said side of said support member being disposed adjacent said back plate of said frame, to provide additional support for said frame.

7. The frame of claim 1 wherein two openings are positioned in said back plate for receiving said projection of said support member, said two openings being disposed in perpendicular relationship to one another.

8. The frame of claim 7 wherein said support member has a support side that is spaced apart from said side with said projection, said support side being disposed at an angle with said side containing said projection so that said support side is substantially parallel with a support surface for said frame when said support member is positioned in either opening in said back plate, said support side being disposed for engaging said support surface when said frame is positioned on said support surface to display an object on said display side of said frame.

9. A frame having a display side for an object and a back plate positioned opposite said display side, said frame being formed of one piece of transparent plastic material, said frame comprising:

two openings positioned in said back plate of said frame, said openings being disposed in substantially perpendicular relationship to one another;

at least two securing devices positioned adjacent each opening, said securing devices being in substantially opposed relationship on opposite sides of each opening, said securing devices forming a passageway, said passageway being narrower than the width of said opening;

a support member having a projection on one side, said projection being disposed for insertion into said opening in said back plate, said projection and support members having a thickness that is slightly larger than said passageway formed by said securing devices, said securing devices engaging said support member to maintain said projection of said support member in said opening, said support member extending from said back plate whereby said support member supports said frame in a manner where an object positioned on said display side can be viewed.

10. A frame for receiving objects to be displayed having a display side for an object and a back plate positioned opposite said display side, said frame comprising:

at least one opening positioned in said back plate of said frame;

at least one securing device positioned adjacent said opening where said securing device extends at least partially over said opening;

a support member having a projection on one side, said projection being disposed for insertion into said opening in said back plate, said securing device engaging said support member to maintain said projection of said support member in said opening, said side of said support where said projection is located extends beyond said projection and beyond said ends of said opening, said side of said support members being disposed adjacent said back plate of said frame to provide additional support for said frame, said support member extending from said back plate whereby said support member supports said frame in a manner where an object positioned on said display side can be viewed.

* * * * *